United States Patent [19]

Cleveland et al.

[11] 4,183,003

[45] Jan. 8, 1980

[54] LOAD-BREAK FUSE EQUIPMENT

[75] Inventors: Lewis C. Cleveland; Howard W. Smith, both of Conover, N.C.

[73] Assignee: General Electric Company, Philadelphia, Pa.

[21] Appl. No.: 916,408

[22] Filed: Jun. 16, 1978

[51] Int. Cl.[2] ..... H01H 71/20

[52] U.S. Cl. ..... 337/156; 337/161; 337/194; 337/229; 337/275; 337/284

[58] Field of Search ..... 337/161, 274, 275, 283, 337/293, 173, 174, 211, 194, 198, 201, 205, 213, 228–231, 237, 246, 284, 143, 156

[56] References Cited

U.S. PATENT DOCUMENTS 3,480,898 11/1969 Giegerich ..... 337/234 X 3,748,621 7/1973 Sakats ..... 337/205 X 3,829,810 8/1974 Giegerich ..... 337/205 X

*Primary Examiner*—R. L. Moses

*Attorney, Agent, or Firm*—William Freedman; Carl L. Silverman

[57] ABSTRACT

This load-break fuse equipment comprises two draw-out fuse assemblies, one of the load-break type and one of the non-load-break type, each removably mounted in its own individual receptacle. The load-break fuse assembly and its receptacle comprise a load-break switch and a fuse electrically connected in series with each other. The non-load-break fuse assembly comprises a fuse, and this fuse is electrically connected in parallel with the fuse of the load-break fuse assembly and in series with said load-break switch.

7 Claims, 3 Drawing Figures

LOAD-BREAK FUSE EQUIPMENT

BACKGROUND

This invention relates to load-break fuse equipment comprising a tubular receptacle and, removably mounted within the receptacle, a load-break drawout assembly that comprises a fuse and the movable contact of a load-break switch.

Examples of load-break fuse equipment of this type are disclosed in U.S. Pat. Nos. 3,471,816—Giegerich; 3,628,092—Keto; and 4,059,816—Bonecutter et al. In certain applications of such load-break fuse equipment, the largest diameter single fuse that is receivable within the receptacle may not have sufficient current-carrying or current-interrupting capacity for the power circuit in which the equipment is to be connected. For such high current applications, it is conventional to provide two identical load-break fuse equipments of this type and to connect them electrically in parallel.

While this approach can provided increased current-carrying and current-interrupting capacity while the two load-break drawout assemblies are in place within their receptacles, it is subject to the distinct disadvantage that the desired current-interrupting capacity is not present during certain intervals while the load-break drawout assemblies are being removed from or being inserted into their receptacles. More specifically, if one of the load-break drawout assemblies of such prior equipment is withdrawn, the fuse of the remaining assembly must alone provide current interrupting ability until the remaining assembly is withdrawn. This same condition is, of course, present if one of the load-break drawout assemblies is inserted before the other one.

SUMMARY

An object of this invention is to provide load-break fuse equipment of this general type that comprises fuses connected in parallel, which fuses remain connected in parallel both during removal and insertion of the load-break drawout assembly.

Another object is to provide load-break fuse equipment comprising a tubular receptacle and a load-break drawout assembly removably mounted therein, which equipment is constructed in such a way that a separate fuse can readily be connected in parallel with the fuse of the drawout assembly and in series with the load-break switch within the receptacle, all without interfering with the easy removability of the drawout assembly and the ability of the load-break switch to interrupt load currents coincident with removal of drawout assembly.

Another object is to achieve the immediately-preceding object without interfering with easy insertability of the drawout assembly and the ability of the load-break switch to close against currents coincident with such insertion, e.g., inrush currents.

In carrying out the invention in one form, we provide two spaced-apart tubular receptacles mounted on a wall. Each receptacle comprises an outboard contact and an inboard contact at axially-spaced locations along the bore of the receptacle, first tubular insulating structure between said contacts, and second tubular insulating structure between the outboard contact and said wall. One of the receptacles further comprises a generally stationary load-break contact at its inner end and a third tubular insulating portion between said load-break contact and its inboard contact.

Insertable as a unit into said one receptacle is a load-break drawout assembly comprising a fuse, two sliding contacts at opposite ends of the fuse, a movable load-break contact inboard of the fuse, and an insulating drawout rod outboard of the fuse. When this drawout assembly is fully inserted, the movable load-break contact engages the stationary load-break contact and the two sliding contacts respectively engage the inboard and outboard contacts of said one receptacle. Insertable as a unit into the other receptacle is a non-load-break drawout assembly comprising a fuse, two sliding contacts at opposite ends of the fuse, and an insulating drawout rod outboard of the fuse; said two sliding contacts respectively engaging the inboard and outboard contacts of said other receptacle when said non-load-break drawout assembly is fully inserted.

Means is provided for electrically connecting said two fuses in parallel with each other and in series with said load-break contacts comprising a first conductor interconnecting the outboard contacts of the two receptacles and a second conductor interconnecting the inboard contacts of the two receptacles.

BRIEF DESCRIPTION OF DRAWINGS

For a better understanding of the invention, reference may be had to the following description taken in conjunction with the accompanying drawings, wherein:

FIG. 2 depicts both drawout assemblies in their fully inserted positions.

DETAILED DESCRIPTION OF PREFERRED EMBODIMENT

Figure 1:
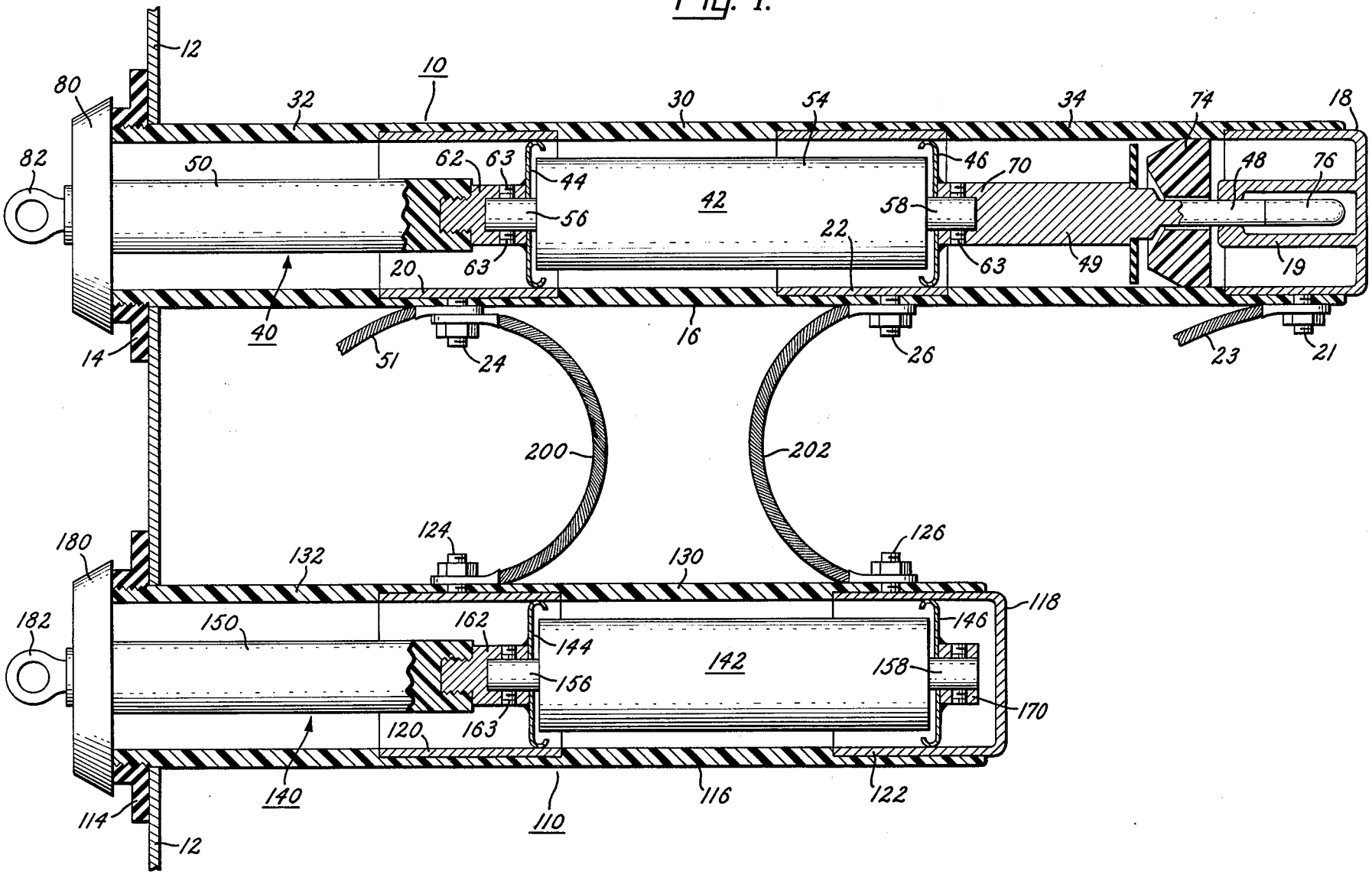
FIG. 1 is a side elevational view, mostly in section, showing load-break fuse equipment embodying one form of the invention.

Referring now to FIG. 1, the illustrated load-break fuse equipment comprises a tubular receptacle 10 that is mounted on a wall 12 of electrical apparatus such as a pad-mounted distribution transformer. The wall 12, which may be of metal, contains an opening through which the tubular receptacle 10 extends, with the bore of the receptacle generally aligned with the opening. A flange 14 on the outer end of the receptacle 10 is attached to the wall 12 by suitable fastening means (not shown). A suitable gasket (not shown) is disposed between the flange 14 and wall 12 to provide a seal between these parts.

In the usual electrical apparatus in which this load-break fuse equipment is used, wall 12 is a portion of a tank filled with a dielectric fluid, such as oil. The receptacle 10 constitutes a dry well projecting into this oil and having its interior sealed from the oil.

The receptacle 10 is primarily formed as a cylindrical insulating tube 16 of oil-resistant, glass-fiber reinforced epoxy material that is suitably jointed at its outboard end to flange 14. At the inboard end of insulating tube 16, there is a cup-shaped metal terminal member 18 suitably attached to tube 16. This metal terminal member 18 carries the stationary socket-type contact 19 of a conventional load-break switch 19, 48 soon t be described. Terminal member 18 also has an external stud 21 to which an external conductor 23 can oe attached for electrically connecting terminal member 18 to an external source circuit (not shown).

Receptacle 10 further comprises two conductive metal sleeves 20 and 22 within the insulating tube 16 at axially-spaced locations along the bore of tube. As will soon appear more clearly, these sleeves 20 and 22 serve as tubular contacts for the load-break drawout assembly that is removably mounted in the receptacle. Sleeve 20 is referred to herein as an outboard contact, and sleeve 22 as an inboard contact. Electrically connected to sleeves 20 and 22 are terminal studs 24 and 26, each of which projects radially through the insulating tube 16 to its exterior.

It will be apparent that receptacle 10 comprises a first tubular insulating portion 30 between the inboard and outboard contacts 20 and 22, a second tubular insulating portion 32 between outboard contact 20 and flange 14, and a third tubular insulating portion 34 between inboard contact 22 and metal terminal member 18 at its inner end that carries stationary load-break contact 19. When the load-break drawout assembly (soon to be described) is not in place within the receptacle, the first insulating portion 30 insulates contacts 20 and 22 from each other; the second insulating portion 32 insulates contact 20 from the metal wall 12; and the third insulating portion 34 insulates the inboard contact 22 from inner end terminal member 18.

Removably mounted within receptacle 10 is a load-break drawout assembly 40. This drawout assembly comprises a current-limiting fuse 42, two sliding contacts 44 and 46 at opposite ends of the fuse, a load-break movable contact rod 48, 49 in a location inboard of the fuse, and a drawout rod 50 of insulating material in a location outboard of the fuse. As will soon appear more clearly, these components 42–50 are all mechanically connected together so that the drawout assembly 40 is removable from receptacle 10 as a unit and is insertable into receptacle 10 as a unit. When load-break drawout assembly 40 is fully inserted into its receptacle, as shown in FIG. 1, an electric circuit extends through the load-break fuse equipment from its outboard terminal 24 to the terminal member 18 at its inner end via a path that extends in series through the contacts 20 and 44, fuse 42, and load-break switch 48, 19. The outboard terminal 24 is connected to a load circuit, e.g., the high voltage winding (not shown) of the transformer, through a suitable conductor 51. The various components of the drawout assembly 40 will now be described in more detail.

Current-limiting fuse 42 is of a conventional design, and, as such, comprises a casing 54 of insulating material, end caps at opposite ends of the casing having rod-type terminals 56 and 58, and fusible elements (not shown) disposed within casing 54 and electrically interconnecting terminals 56 and 58. Casing 54 contains an arc-extinguishing filler material, such as quartz sand, in which the fusible elements are embedded.

The drawout rod 50 has a cup-shaped metal end fitting 62 at its inboard end that snugly receives the fuse terminal 56. A plurality of set screws 63 extend radially through end fitting 62 and clamp the end fitting and fuse terminal 56 together. The sliding contact 44 is attached to the end fitting 62 by suitable means providing a good electrical connection therebetween. In the illustrated embodiment, this sliding contact 42 is a disc of highly conductive metal having at its outer periphery circumferentially-spaced fingers of U-shaped cross section that press radially outward against the sleeve contact 20. Other suitable forms of sliding contact may, of course, be used in this location. When the terminal stud 24 is connected to an external circuit, current can flow from terminal stud 24 to the fuse terminal 56 via a path that extends in series through sleeve contact 20, sliding contact 44, and end fitting 62.

The contact rod 48, 49 at the inboard end of fuse 42 has an end fitting 70 that receives fuse terminal 58 and is clamped thereto by set screws in the same way as parts 62 and 56 are clamped together at the outboard end of the fuse. The sliding contact 46 at the inboard end of the fuse is of essentially the same construction as previously-described sliding contact 44 and is suitably attached to end fitting 70. When terminal stud 26 is connected to an external circuit, current can flow between stud 26 and contact rod 48, 49 via a path extending through the following parts in series: 26, 22, 46, 70, and 48, 49.

Contact rod 48, 49 is slidably received within the bore of tulip-type stationary contact structure 19, which comprises circumferentially-spaced fingers biased radially inward by suitable means (not shown) to provide increased contact pressure between contact 19 and 48. Contacts 19 and 48 may be thought of as load-break contacts since they are usually separated while load current is flowing through them when the drawout assembly 40 is withdrawn.

Current interruption at the load-break contacts is effected in a conventional manner. More specifically, an arc is drawn between contacts 19 and 48 when rod 48 is withdrawn from contact 19, and this arc reacts with gas-evolving material in this region to produce an arc-extinguishing gas that acts to quickly extinguish the arc. Such gas-evolving material is present in the form of a stationary snuffer tube 76 surrounding rod 46 and a follower 76 attached to contact rod 48.

The drawout assembly 40 further includes a flange 80 at its outboard end that seats against the flange 14 of receptacle 10 when the drawout assembly is fully inserted, as shown in FIG. 1. Flange 80 can be moved to the left by applying force to an eye bolt 82 secured to the flange. Such force is applied through a conventional hot-stick attached by an operator to eye bolt 80.

When eye bolt 80 is thus pulled to the left, the entire load-break drawout assembly 40 is moved to the left and is eventually withdrawn from receptacle 10. Such withdrawal results, first of all, in the circuit through the device being interrupted at the load-break contacts 19 and 48, as above described. The sliding contacts 44 snd 46 are then still in engagement with their associated contact sleeves 20 and 22 so that there is no arcing at these contacts. When the drawout assembly 40 has been withdrawn sufficiently to complete the load-break operation and disconnect the circuit, the sliding contacts 44 and 46 separate from their associated contacts 20 and 22, and the drawout assembly is then completely withdrawn.

When the drawout assembly 40 is in its fully inserted position of FIG. 1, the current-limiting fuse 42 functions in a conventional manner to protect the transformer against short-circuit and other abnormal currents flowing through the load-break fuse equipment. More specifically, if current through the fuse exceeds a predetermined value, portions of the fusible elements therein rapidly vaporize, creating arcs that are rapidly extinguished and prevented from reigniting by the interaction of the arc and the filler material within the fuse. Such operation of the fuse acts in a conventional manner to limit the current therethrough to a value far below the maximum available current of the circuit.

In certain applications, any single fuse (42) which will properly fit within the receptacle 10 may not have sufficient current-carrying capacity and/or sufficient current-interrupting capacity to adequately protect the transformer. To provide adequate protection for such applications, we connect a separate fuse 142 in parallel with the above-described fuse 42 and in series with the contacts 48, 19 of the load-break switch.

This separate fuse 142 is part of a non-load-break drawout assembly 140 mounted in a receptacle 110 located adjacent receptacle 10. Receptacle 110 is in many respects similar in construction to receptacle 10, and most of its parts have therefore been assigned the same reference numerals as corresponding parts of receptacle 10 except for the addition of the prefix "1." Similarly, drawout assembly 140 is similar in many respects to drawout assembly 40, and most of its parts have been assigned the same reference numerals as corresponding parts of drawout assembly 40 except for the addition of the prefix "1." To avoid repetition, only the differences in the two side-by-side assemblies will be described.

The non-load-break drawout assembly 140 differs from the load-break drawout assembly 40 in that it terminates at the end fitting (170) that receives the inboard fuse terminal (158). Thus, there is no load-break switch at the inboard end of the drawout assembly 140.

The receptacle 110 differs from receptacle 10 in that it terminates at its inboard end just past the inboard fuse terminal 158. An end cap 118 is suitably attached to insulating tube 116 to provide a leak-proof end construction for the receptacle.

For electrically connecting the two fuses 42 and 142 in parallel with each other and in series with the load-break switch 19, 48, a pair of flexible conductors 200 and 202 are provided. Conductor 200 is connected between terminals 24 and 124 of the two receptacles, and conductor 202 is electrically connected between terminals 26 and 126 of the two receptacles. This parallel connection of the fuses enables the fuses to share the continuous current-carrying duty and also the current-interrupting duty, thus enabling the protective equipment to handle higher continuous and available short-circuit currents.

When it is desired to disconnect the transformer winding from the incoming conductor 23, the load-break drawout assembly 40 is withdrawn from its receptacle 10, thus breaking the load current at the load-break switch 19, 48 and isolating the load side lead 51 from incoming (or source) lead 23. Because the load-break switch 19, 48 is in series with both fuses 42 and 142, it is to be noted that the fuses remain in parallel during the load-breaking operation, and thus both are available during this interval to share in interrupting possible short-circuit or other abnormal currents. Similarly, if the load-break drawout assembly 40 is inserted while the fuse assembly 140 is in place within its receptacle, the parallel combination of fuses is available to share the interrupting duty from the instant that the load-break switch 19, 48 reestablishes the power circuit.

The above operation is in distinct contrast to that present when two load-break fuse assemblies are provided and are connected completely in parallel, as in the prior art. When the drawout assembly of one of these fuse assemblies is removed, the remaining one carries all the current and its fuse may be called upon to interrupt possible short-currents alone and without assistance from the first fuse should a fault occur during this interval. Similarly, should one of these drawout assemblies be inserted prior to insertion of the other one, the first-inserted one may be called upon to handle possible short-circuit, or other abnormal, currents unassisted until the other one is inserted.

The load-break fuse assembly 10, 40 is structurally quite similar to a prior load-break fuse assembly manufactured by the assignee of the present invention and can therefore be manufactured using most of the same parts as with the prior load-break fuse assembly and without drastically changing the manufacturing process. But, there is at least one important structural difference between the load-break fuse assembly 10, 40 and the prior load-break fuse assembly, and that resides in the presence of the inboard sliding contact 46 and the inboard sleeve contact 22 and terminal 26 at the inboard end of the fuse, which components are not present in the prior load-break fuse assembly.

Although the fuse 142 is connected in parallel with fuse 42 and in series with load-break switch 19, 48, it is to be noted that the load-break drawout assembly can be removed and reinserted without interference from the extra fuse 142 and in generally the same straightforward manner as previously.

Figure 2:
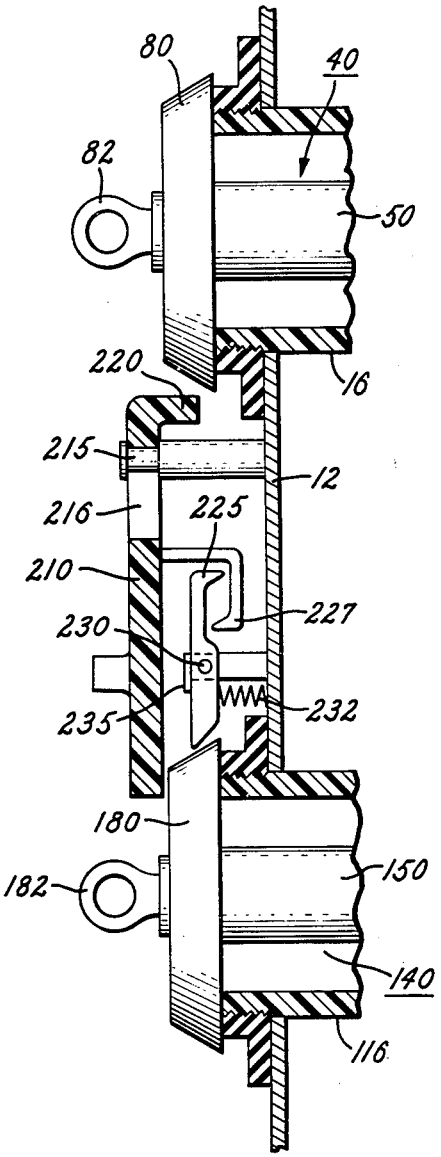
FIG. 2 is a sectional view of an interlock used with the fuse equipment of FIG. 1 for ensuring a predetermined sequence of operations during withdrawal and insertion of the drawout fuse assemblies.
Figure 3:
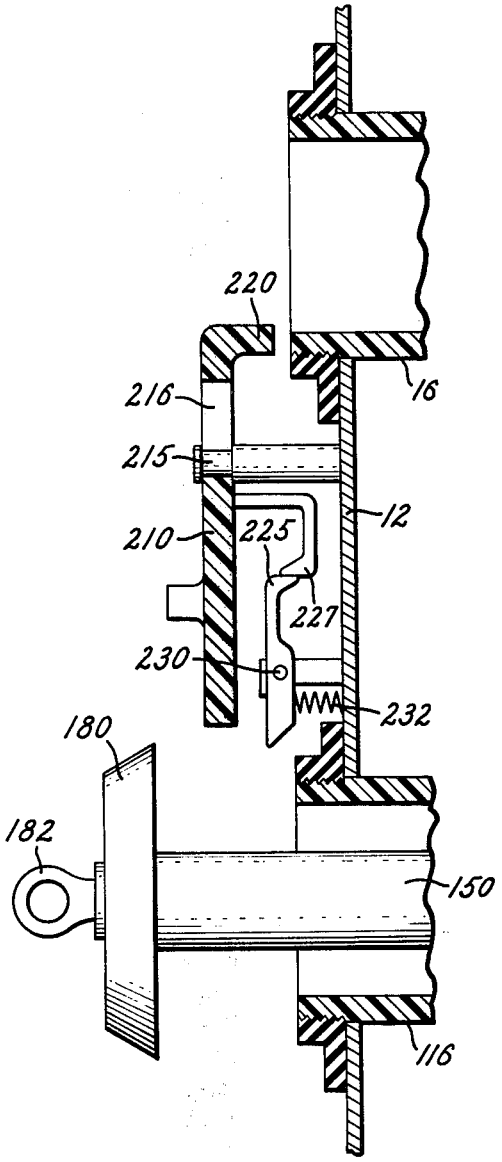
FIG. 3 is another view of the interlock of FIG. 2 showing the interlock with the drawout fuse assemblies removed.

It is important, however, that the two drawout fuse assemblies be withdrawn in the proper sequence and also reinserted in the proper sequence. More specifically, it is important that the load-break drawout assembly 40 be withdrawn before the non-load-break drawout assembly 140 and be reinserted after the non-load-break assembly 140. Unless this sequence is followed, there will be an interval during each of these operations when only one fuse will be connected in the circuit and will be available to interrupt possible short-circuit currents. To assure that the correct sequence is followed in these operations, an interlock arrangement such as shown in FIGS. 2 and 3 is provided.

This interlock arrangement comprises a barrier 210 that is mounted on the outside of wall 12 and is guided for movement in a vertical path only by suitable pin and slot connections, one of which is shown at 215, 216. When the drawout assemblies are both in their fully-inserted position of FIG. 1, the barrier 210 is in a position to block drawout motion of the lower, or non-load-break, drawout assembly 140. If an attempt is made to lift the barrier 210 to unblock the lower drawout assembly, such lifting of the barrier is blocked by the flange 80 of the upper drawout assembly 40, which is in the path of a projection 220 on the barrier. Thus, the lower drawout assembly is prevented from being withdrawn before the upper drawout assembly is withdrawn.

When the upper drawout assembly is withdrawn, upward movement of the barrier 210 is no longer blocked by flange 80, and the barrier 210 can therefore be lifted to unblock the lower drawout assembly, thus permitting its withdrawal.

When barrier 210 is thus lifted into an unblocking position with respect to the lower drawout assembly 140, it is latched in its elevated position by a latch 225 cooperating with a projection 227 on the barrier 210. This latch 225 is pivotally mounted on a stationary pivot 230 and is biased counterclockwise by a spring 232 against a generally stationary, but slightly yieldable, stop 235. When the barrier 210 is lifted, the latch is temporarily brushed aside by projection 227 but is pivoted counterclockwise into place underneath the projection 227 when the projection moves above the latch.

When the lower drawout assembly is withdrawn, the flange 180 will pivot latch 225 clockwise a short distance against yieldable stop 235 but not enough to release latch 225 from projection 227. Thus, the barrier 210 remains in its elevated position of FIG. 3 when both drawout assemblies are withdrawn. When barrier 210 is in this position, it blocks insertion of the upper drawout assembly. It is necessary to first insert the lower drawout assembly. During such insertion, the outer periphery of flange 180 of the lower drawout assembly trips latch 225, allowing barrier 210 to fall into place behind flange 180 on the lower drawout assembly. When flange 180 nears its fully-seated position, the latch 225 is free to reset by pivoting counterclockwise into its position of FIG. 2.

It is to be understood that our invention in its boarder aspects is not limited to any particular form of interlock. But it is highly desirable that some means be provided for providing reasonable assurance that the desired sequence of operations will be followed both during withdrawal and during reinsertion of the drawout fuse assemblies.

While I have shown only a single phase form of the invention, it is to be understood that the invention is readily usable for polyphase apparatus. In such apparatus, an assembly corresponding to that shown in FIG. 1 is provided for each phase; and, preferably, a suitable interlock is provided which assures that all of the load-break drawout assemblies will be withdrawn before any of the non-load-break assemblies are withdrawn and also assures that all of the non-load-break assemblies will be inserted before any of the load break assemblies are inserted.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. In combination, (a) a wall having two spaced-apart openings, (b) two tubular receptacles having bores respectively generally aligned with said openings and each having one end secured to said wall and its opposite end spaced from the wall, (c) each receptacle comprising: an outboard contact and an inboard contact at axially-spaced locations along the bore of said receptacle, first tubular insulating structure insulating said contacts of a receptacle from each other when the receptacle is empty, and second tubular insulating structure insulating the outboard contact of a receptacle from said wall, (d) one of said receptacles further comprising a third tubular insulating portion located axially inwardly of the inboard contact of said one receptacle, (e) a generally stationary load-break contact at said opposite end of said one receptacle and insulated from said inboard contact by said third tubular insulating portion when said one receptacle is empty, (f) a load-break drawout assembly, insertable as a unit into said one receptacle and also removable as a unit therefrom, comprising: an electric fuse, two sliding contacts at opposite ends of the fuse, a movable load-break contact inboard of said fuse, and an insulating drawout rod at the outboard end of said fuse; said movable load-break contact engaging such stationary load-break contact, and said two sliding contacts respectively engaging said inboard and outboard contacts of said one receptacle when said drawout assembly is fully inserted, (g) a non-load-break drawout assembly insertable into said other receptacle as a unit and also removable therefrom as a unit comprising: an electric fuse, two sliding contacts at opposite ends of the fuse, and an insulating drawout rod at the outboard end of said fuse; said two sliding contacts respectively engaging said inboard and outboard contacts of said other receptacle when said non-load-break drawout assembly is fully inserted, (h) and means for electrically connecting said two fuses in parallel with each other and in series with said load-break contacts comprising a first conductor interconnecting the outboard contacts of the two receptacles and a second conductor interconnecting the inboard contacts of the two receptacles.

2. The apparatus of claim 1 in which said fuses remain connected in parallel while said load-break contacts are being separated.

3. The apparatus of claim 1 in combination with interlock means preventing withdrawal of said non-load-break drawout assembly from its receptacle before said load-break drawout assembly is withdrawn from its receptacle.

4. The apparatus of claim 1 in combination with interlock means preventing insertion of said load-break drawout assembly into its receptacle before said non-load-break drawout assembly is inserted into its receptacle.

5. The apparatus of claim 3 in combination with interlock means preventing insertion of said load-break drawout assembly into its receptacle before said non-load-break drawout assembly is inserted into its receptacle.

6. The apparatus of claim 1 in which:

(a) said inboard and outboard contacts of said one receptacle are conductive sleeves surrounding said bore of the associated receptacle, and (b) the sliding contacts of the load-break drawout assembly respectively engage said sleeves when the load-break drawout assembly is near its fully-inserted position.

7. The apparatus of claim 1 in which the two sliding contacts of the load-break drawout assembly remain in contact with the inboard and outboard contacts of said one receptacle during withdrawal of said load-break drawout assembly until interruption is completed at said load-break contacts.

* * * * *